United States Patent [19]

Seagrave, Jr.

[11] 4,004,750

[45] Jan. 25, 1977

[54] METHOD AND APPARATUS FOR CONTROLLING THE STOCK TENSION AS IT IS WITHDRAWN FROM A COIL

[75] Inventor: Earl M. Seagrave, Jr., Rockford, Ill.

[73] Assignee: Antek, Inc., Rockford, Ill.

[22] Filed: Aug. 29, 1975

[21] Appl. No.: 609,107

[52] U.S. Cl. ..... 242/75.43; 242/78.6

[51] Int. Cl.[2] ..... B65H 75/22; B21C 47/16

[58] Field of Search ..... 242/78.6, 75, 75.46, 242/75.43, 75.44, 75.53, 78.7; 226/195

[56] References Cited

UNITED STATES PATENTS

| | | | |
|---|---|---|---|
| 2,023,502 | 12/1935 | Armstrong | 242/75 |
| 2,472,548 | 6/1949 | Schnell | 242/75 |
| 3,258,219 | 6/1966 | McLendon | 242/86.7 |
| 3,306,551 | 2/1967 | Martin | 242/75.46 |
| 3,717,313 | 2/1973 | Williams | 242/78.6 |
| 3,749,136 | 7/1973 | Robinson | 242/75.43 |

*Primary Examiner*—Edward J. McCarthy
*Attorney, Agent, or Firm*—Morsbach & Pillote

[57] ABSTRACT

A method and apparatus for controlling stock tension as it is withdrawn from a coil in which a coil support is mounted for rotation about an axis transverse to the direction of withdrawal of stock from the coil and also for limited shifting movement along a path lengthwise of the direction of stock withdrawal. Shifting movement of the coil support in the direction of stock withdrawal is yieldably opposed with a generally uniform biasing force and the rotation of the coil about its axis is variably braked in response to shifting of the coil along said path to maintain the exiting tension on the stock substantially equal to the biasing force.

16 Claims, 4 Drawing Figures

METHOD AND APPARATUS FOR CONTROLLING THE STOCK TENSION AS IT IS WITHDRAWN FROM A COIL

BACKGROUND OF THE INVENTION

Stock pay-off apparatus have heretofore been made which brake rotation of a coil of continuous flexible stock in order to control the tension on the stock as it is withdrawn from the coil. Some stock pay-off apparatus utilize a substantially constant braking action on the coil and are objectionable because the tension on the exiting stock changes with the size of the coil. Other systems engage the stock as it exits from the coil to sense the tension in the stock and to operate a variable brake means accordingly. Such systems are not entirely satisfactory where the exiting stock might be damaged by contact with the tension sensing mechanism. Further, many stock tension control devices require external power, either electric, pneumatic or hydraulic, and this increases the expense and difficulty in installing and in moving the stock pay-off apparatus from place to place.

The present invention relates to a method and apparatus for controlling the stock tension as it is withdrawn from a coil.

An important object of this invention is to provide a method and apparatus for controlling the tension on flexible stock as it is withdrawn from a coil in which the exiting tension is maintained generally uniform independent of the diameter of the coil.

Another object of this invention is to provide an apparatus for controlling the tension on continuous flexible stock as it is withdrawn from a coil in which the tension on the exiting stock is sensed without contacting the stock after it exits from the coil.

Still another object of this invention is to provide a method and apparatus for controlling the tension on flexible stock as it is withdrawn from a coil which does not require any external power source for applying braking action to the coil.

Accordingly, the present invention provides a method for controlling the tension on continuous flexible stock as it is withdrawn from a coil in which the coil is supported for axial rotation about an axis extending transverse to the direction of stock withdrawal and for limited shifting movement lengthwise of the direction of stock withdrawal, the shifting movement of the coil in the direction of stock withdrawal being yieldably opposed with a generally uniform biasing force, and the rotation of the coil being variably braked as it shifts in the direction of stock withdrawal until the exiting tension on the stock substantially equals the biasing force that opposes the shifting of the coil in the direction of stock withdrawal.

The present invention further provides an apparatus for controlling the tension on the stock as it is withdrawn from a coil in which a carriage is mounted on a frame for movement relative thereto along a path generally lengthwise of the direction of stock withdrawal, a coil support is mounted on the carriage for rotation about an axis transverse to the path, biasing means yieldably urges the carriage along the path toward a retracted position, variable brake means controls rotation of the coil on the support, and mechanism operative in response to movement of the carriage along the path operates the variable brake means to increase and decrease the braking action as the carriage moves respectively toward and away from its retracted position. The carriage biasing means preferably applies a generally uniform force to urge the carriage toward its retracted position to thereby maintain a substantially constant tension on the stock as it is withdrawn from the coil.

These, together with other objects, features and advantages of the invention will be more readily understood by reference to the following detailed description when taken in connection with the accompanying drawings wherein.

Figure 1:
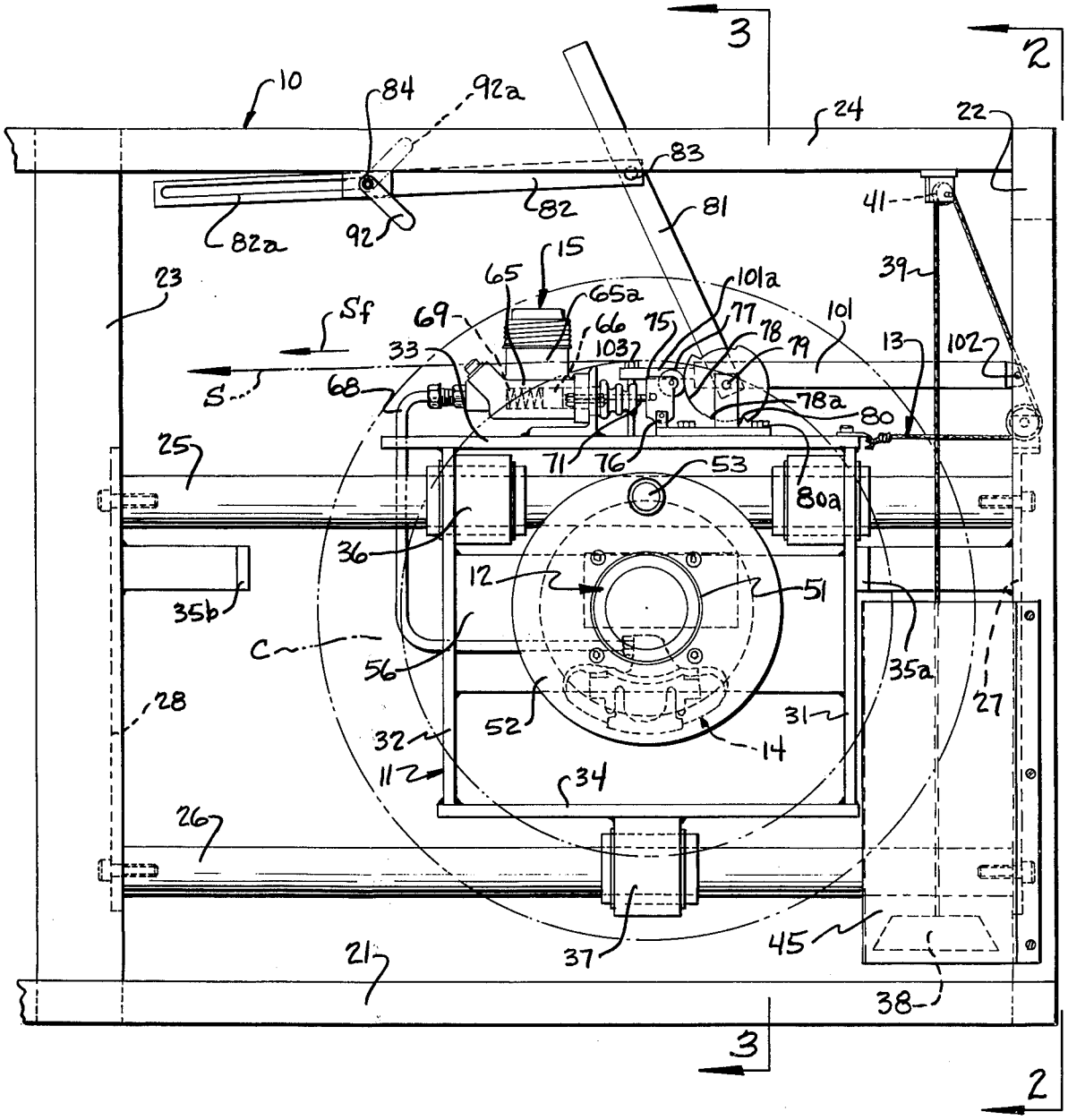
FIG. 1 is a side elevational view of a stock payoff apparatus embodying the present invention, with the stock reel shown in phantom.

The method and apparatus of the present invention is generally adapted for use in paying off continuous flexible stock from a coil to control the tension in the stock as it is withdrawn by a subsequent processing machine. The apparatus may, for example, be used in controlling the tension in wire and thin flexible strip stock as it is unwound from a coil and the apparatus may be used with various different stock processing machines operable to withdraw stock from the coil. For example, the stock processing machine can be of the type that withdraws the stock S from the coil in the direction indicated by the arrow S*f*, by rewinding the same on a mandrel or core as diagrammatically shown at 9 in FIG. 4 or the stock processing machines can be of the type that have a separate stock feed mechanism for pulling the wire from the supply coil and for advancing the same through the processing machine. Moreover, as will appear more fully hereinafter, the stock pay-off apparatus can be utilized not only with processing machines that effect withdrawal of stock at a uniform rate, but also with processing machines that withdraw the stock at a non-uniform rate or even intermittently.

The stock pay-off apparatus in general includes a stationary frame 10 having a carriage 11 mounted on the frame for movement along a path generally lengthwise of the direction in which the wire is to be withdrawn, and a coil support 12 mounted on the carriage for rotation about an axis transverse to that path. The carriage is yieldably biased to a retracted position by a carriage biasing apparatus 13. A variable brake mechanism 14 controls rotation of the coil support and a brake operating mechanism 15 variably operates the brake mechanism in response to movement of the carriage along the path to maintain a generally uniform tension on the stock as it exits from the coil. The carriage is preferably mounted for movement along a generally horizontal path and the pay-off apparatus is arranged so that the stock as it exits from the reel to the processing machine extends generally lengthwise of the path of movement of the carriage. As will be understood, the stock pay-off apparatus can either be arranged with relation to the subsequent processing machine as diagrammatically shown in FIG. 4 so that the stock passes directly to the processing machine or intermediate stock guides can be provided for guiding the stock from the pay-off apparatus to the processing machine.

The stationary frame 10 can be of any suitable construction and, as herein shown, includes a base 21, upright support members 22 and 23 spaced apart along the base and upper frame members 24 extending between the upper ends of the upright members 22 and 23. Guide rails 25 and 26 are secured as by plates 27 and 28 to the uprights 22 and 23 respectively and the guide rails extend generally lengthwise of the path of travel of the stock as it exits from the stock reel.

The carriage 11 is mounted on the guide rails 25 and 26 for movement therealong and, as herein shown, the carriage includes spaced end members 31 and 32 interconnected by upper and lower members 33 and 34. The carriage is slidably mounted on the guide rails as by bushings 36 and 37 and stops 35*a* and 35*b* are provided on the frame 10 to engage the carriage and limit movement of the carriage between a retracted position adjacent stop 35*a* and an extend position adjacent stop 35*b*. The carriage is yieldably urged by a carriage biasing mechanism in a direction opposite the direction in which the stock is withdrawn from the coil to its retracted position. The carriage biasing mechanism is preferably arranged to apply a generally uniform force to bias the carriage towards its retracted position and the carriage is conveniently weight biased by means of an adjustable weight mechanism 38 that is connected through a cable 39 entrained over pulleys 41 and 42 on the frame and connected to the carriage 11, as best shown in FIG. 1. The size of the weights 38 can be varied to adjust the carriage biasing force and, as will be apparent, the carriage biasing force remains constant as the carriage moves along the guide rails. A housing 45 is conveniently mounted on the frame to guide and shroud the weights from engagement with obstructions.

Figure 2:
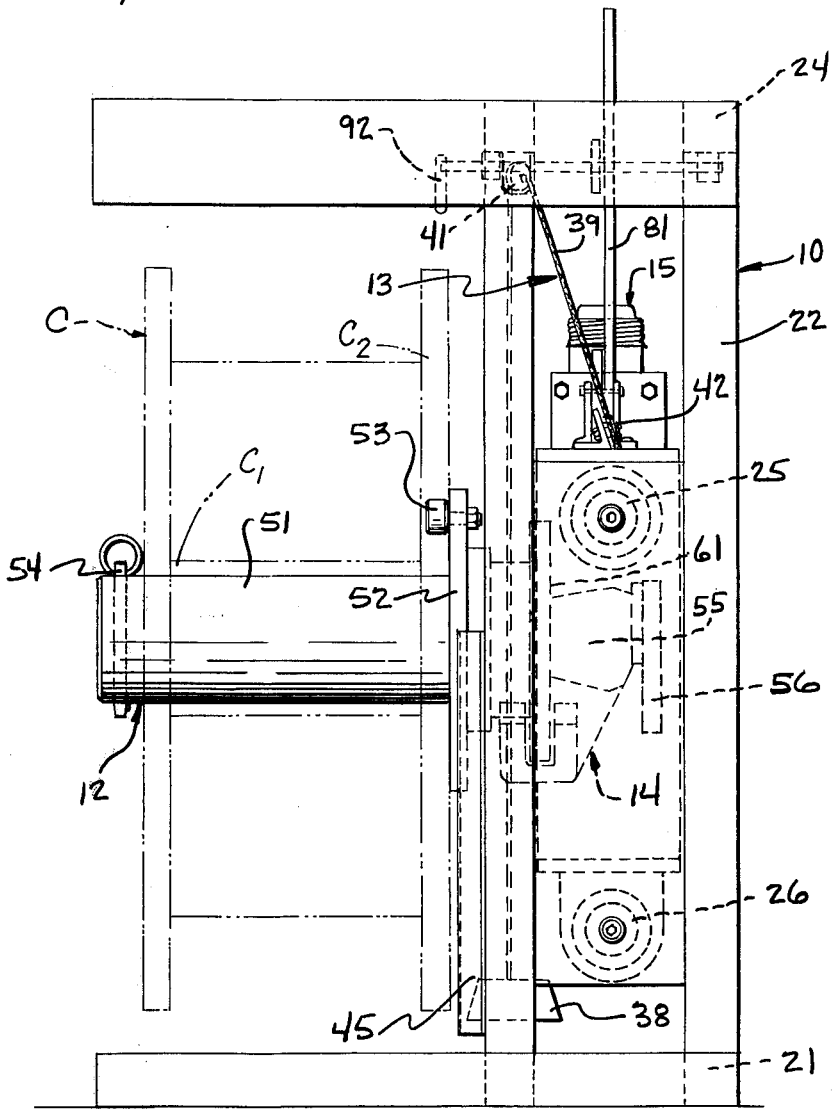
FIG. 2 is an end elevational view taken on the plane 2—2 of FIG. 1.

The stock coil C, shown in phantom in FIGS. 1 and 2, is mounted on a coil support 12 for rotation about an axis transverse to the path of movement of the carriage. In the embodiment illustrated, the coil support is mounted for rotation about a generally horizontal axis transverse to the path of movement of the carriage, it being understood that the coil support could be mounted for rotation about a different transverse axis and may, for example, be mounted for rotation about an upright axis. The coil support includes a drum 51 adapted to extend through the hub C1 of the stock coil and having a drive plate 52 at one end with a drive dog 53 adapted to extend through the opening or hole in the end flange C2 of the stock coil to non-rotatably connect the coil to the coil support. A means such as a removable pin 54 is provided on the coil support for removably retaining the stock coil on the coil support. Any suitable means may be provided for rotatably mounting the coil support on the carriage and, in the embodiment shown, a spindle 55 (FIG. 3) is rigidly mounted on an intermediate frame member 56 on the carriage and a hub 57 is secured to one end of the coil support drum 51 and is rotatably supported as by bearings 58 on the spindle.

Figure 3:
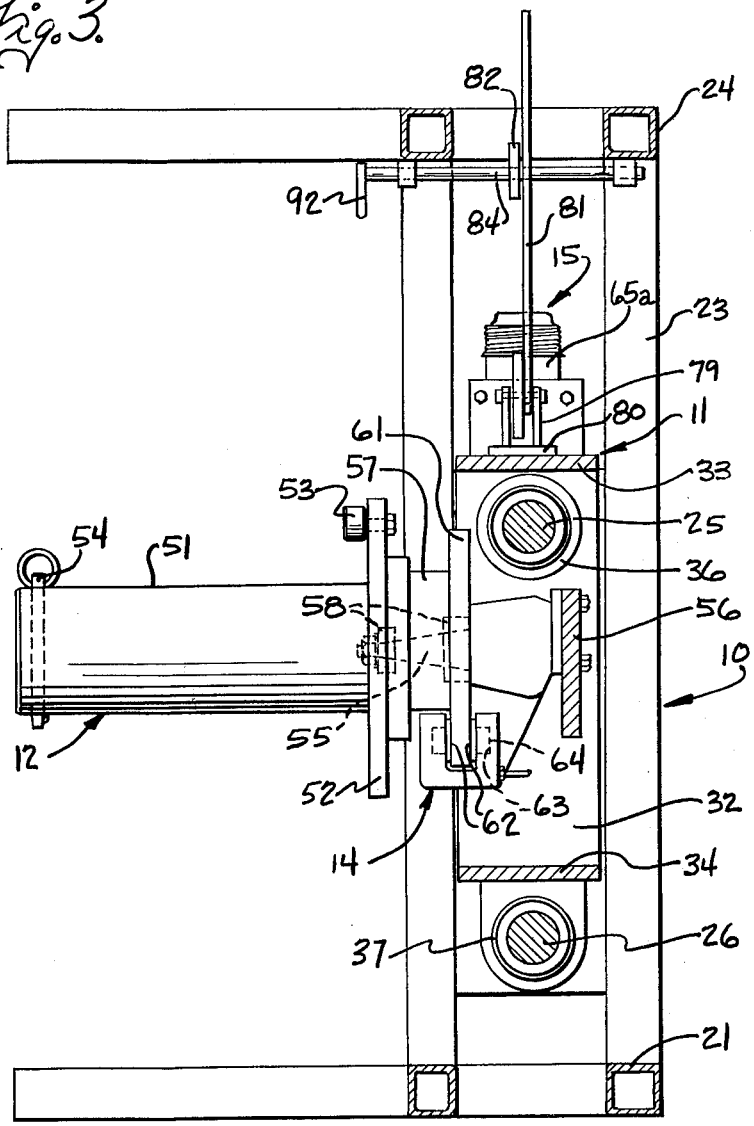
FIG. 3 is a transverse sectional view taken on the plane 3—3 of FIG. 1.

The brake mechanism 14 for controlling rotation of the coil support is conveniently of the disc type and, as best shown in FIG. 3, includes a brake disc 61 connected to the hub 57 for rotation with the coil support drum 51, and brake pads 62 adapted to be pressed against on opposite sides of the brake disc to produce a variable braking action correlative with the pressure applied to the brake pads. The brake actuating mechanism 15 is advantageously of the hydrostatic pressure type which includes a brake cylinder and piston means 63, 64 (FIG. 3) for pressing the brake pads 62 against the disc, and a master cylinder and piston means 65, 66 (FIG. 1) that is hydrostatically connected as through a tube 68 to the brake cylinder and piston means. The master cylinder and piston means 65, 66 and the brake cylinder and piston means 63, 64 can conveniently be of the type commonly utilized in automobile braking systems and detailed description of their construction and operation is accordingly deemed unnecessary.

In general, the master piston 66 is yieldably biased to a retracted position in the master cylinder 65 by a spring 69 and the master cylinder includes a fluid reservoir 65*a* and suitable valves (not shown) to maintain the master cylinder and the hydraulic lines filled with liquid when the master piston is in its retracted position. The master piston is operated from a plunger 71 that extends externally of the master cylinder, and the master cylinder and piston applies pressure through the lines 68 to the brake cylinder and pistons 64. The disc brakes herein illustrated can be of the fixed caliper or floating caliper type and include one or more brake pistons for controlling application of pressure to the brake pads. In order to achieve force amplification, the cross-sectional area of the master cylinder and piston is made smaller than the cross-sectional area of the brake cylinder and pistons.

The brake actuating mechanism 15 is operated in response to movement of the carriage along the path to increase and decrease the braking pressure and consequently the braking action on the coil support drum as the carriage respectively moves toward and away from its retracted position to maintain the exiting tension on the stock substantially equal to the force biasing the carriage toward its retracted position. As best shown in FIG. 1, actuating plunger 71 for the master cylinder is connected to a lever 75 that is pivotally mounted on a bracket 76 on the carriage and which has a cam follower roller 77 at its upper end. A cam 78 is rotatably mounted on a bracket 79 on the carriage and is operated by a lever 81. Brackets 76 and 79 are conveniently secured to a common base 80 that is adjustably mounted on the carriage 11 as by bolts 80*a* for limited adjustment in a direction toward and away from the master cylinder 65 to substantially eliminate free travel between the cam 78 and the master cylinder plunger 71. The lever 81 is non-rotatably connected to the cam 78 and the upper end of the lever is normally held against movement by a link 82 that is pivotally attached at one end 83 to the lever and which is pivotally and releasably anchored by a latch 84 at its other end on the frame. Thus, the pivot point 83 will normally remain fixed as the carriage moves along the rails 25 and 26 and the cam will be rotated relative to the follower 77 to actuate the master cylinder piston 66. The automotive type hydraulic brakes generally do not have a linear piston movement to brake-torque characteristic and the cam 78 is shaped so as to operate the master cylinder piston to respectively increase and decrease the braking action on the coil support in a generally linear manner as the carriage respectively moves toward and away from its retracted position. The cam 78 also has a relieved area 78*a* angularly spaced from the cam surface 78, and which is arranged to release the brake piston when the relieved area is opposite the follower 77, to thereby enable free rotation of the coil support drum 12 and coil C. As shown in FIG. 1, the link 82 has a longitudinal slot 82*a* in one end portion and the releasable latch 84 is operable by a lever 92 movable between a latch position shown in solid lines in FIG. 1, in which it anchors the link against endwise movement in the position shown in FIG. 1, and a release position shown in dotted lines in FIG. 1, in which it allows movement of the link 82 to the right as viewed in FIG. 1 to position the cam recess 78*a* opposite the follower 77.

In some applications, for example when rewinding the stock on a non-circular coil or arbor, the rate of withdrawal of the stock from the coil is non-uniform. In order to damp oscillation of the carriage due to the non-uniform rate of withdrawal of the stock in such applications, a fluid dampner including a cylinder 101 having a piston 101*a* slidable therein is connected to the frame and carriage. As shown, one end of the cylinder 101 is mounted at 102 on the frame and the outer end of the piston 101*a* is mounted at 103 on the carriage, with the cylinder extending generally lengthwise of the path of travel of the carriage.

Figure 4:
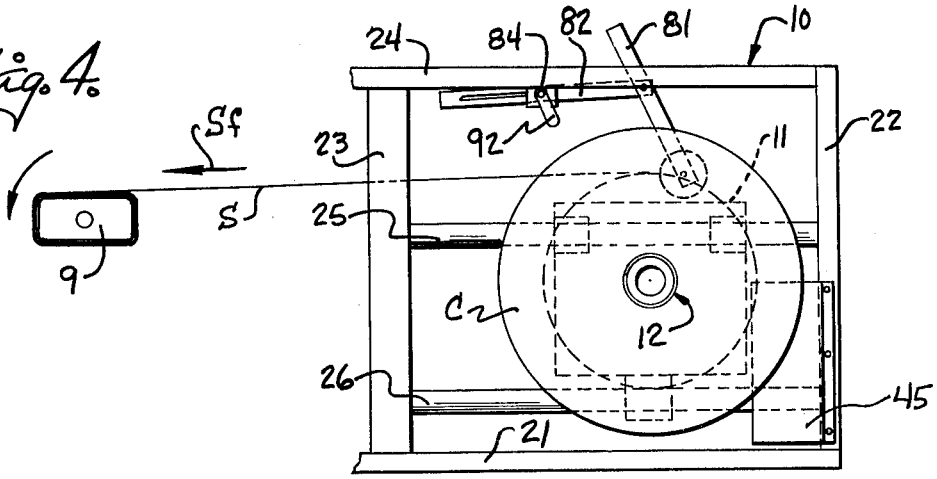
FIG. 4 is a side view illustrating application of the stock pay-off apparatus to a wire processing machine.

From the foregoing it is felt that the construction and operation of the stock pay-off apparatus will be readily understood. The coil C of stock is non-rotatably keyed to the coil support so that the coil support is rotated in response to withdrawal of stock. The tension in the stock as it is withdrawn is controlled by brake 14 and, if the braking action is such that the existing tension slightly exceeds the biasing force exerted on the carriage by the weight 38, the carriage will begin to move in the direction of withdrawal of the stock. Lever 81 operates the cam 78 to decrease the braking pressure and consequently the braking action as the carriage moves in the direction of withdrawal of the stock. Conversely, if the tension on the exiting stock starts to decrease below the biasing force exerted on the carriage by the weight 38, the carriage will tend to move in a direction opposite the direction of withdrawal of the stock and the brake will be automatically operated to increase the braking action on the coil support until the exiting tension again equals the biasing force exerted by the weight 38. In this manner, the carriage will shift along the support rails 25 and 26 to a position intermediate the retracted and extended positions and at which the braking action exerted on the coil support maintains the tension in the exiting webs substantially equal to the biasing force exerted by the weight 38. Thus, the exiting tension is maintained substantially uniform and equal to the biasing force of the weight 38, and independent of the change in diameter of the coil of stock as it is unwound. Moreover, it will be seen that the movement of the carriage along the support rails functions as an accumulator to allow non-uniform rate of withdrawal of stock without a corresponding rotational acceleration and deceleration of the coil of stock. This enables the coil pay-off apparatus to be used in applications wherein the rate of withdrawal is non-uniform and where it cyclicly varies, for example when winding on a non-circular core or mandrel as shown in FIG. 4. Moreover, it will be seen that the pay-off apparatus maintains a tension in the exiting web even when the widthrawal of web stock is interrupted. In addition, the coil pay-off apparatus operates to maintain the substantially constant tension in the exiting stock without requiring a tension sensing member such as a dancer roll that engages the exiting stock. This is of particular importance in those applications where a tension sensing device such as a dancer roll engaging the exiting stock may cause damage to the stock or a coating on the stock.

While the form of apparatus herein described constitutes a preferred embodiment of the invention, it is to be understood that the invention is not limited to this precise form of apparatus, and that changes may be made therein without departing from the scope of the invention which is defined in the appended claims.

The embodiments of the invention in which the exclusive property or privilege is claimed are defined as follows:

1. A flexible stock pay-off apparatus for controlling tension on continuous flexible stock as it is withdrawn from a coil, the pay-off apparatus including a frame, a carriage mounted on the frame for movement relative thereto along a path between a retracted position and an extended position, a coil support mounted on the carriage for rotation about an axis transverse to said path in response to withdrawal of stock from a coil on the support, means yieldably urging the carriage along said path toward said retracted position, variable brake means for controlling rotation of a coil on said coil support, and means operative in response to movement of the carriage along the path for variably operating the brake to increase and decrease the braking action as the carriage moves respectively toward and away from said retracted position.

2. A flexible stock pay-off apparatus according to claim 1 wherein said means for actuating the brake means includes hydrostatic pressure means for applying braking pressure to said brake means correlative with the displacement of said carriage from said retracted position.

3. A flexible stock pay-off apparatus according to claim 2 wherein said hydrostatic pressure means is mounted on said carriage.

4. A flexible stock pay-off apparatus according to claim 1 wherein said means for actuating the brake means comprises a hydrostatic pressure means, said hydrostatic pressure means including brake cylinder and piston means for applying braking pressure to the brake means and a master cylinder and piston means hydrostatically connected to the brake cylinder and piston means, and means for relatively moving the master cylinder and piston means in response to movement of said carriage relative to said frame to respectively increase and decrease the pressure applied to the brake means as the carriage moves toward and away from its retracted position.

5. A flexible stock pay-off apparatus according to claim 4 wherein said means for relatively moving the master cylinder and piston means includes cam means shaped to cause the braking action to change in a generally progressive fashion with displacement of the carriage from its retracted position.

6. A flexible stock pay-off apparatus according to claim 4 wherein said hydrostatic pressure means is mounted in said carriage.

7. A flexible stock pay-off apparatus according to claim 1 including means for damping oscillation of said carriage along said path.

8. A flexible pay-off apparatus according to claim 1 wherein said carriage is mounted for movement along a generally horizontal path.

9. A flexible stock pay-off apparatus according to claim 1 wherein said carriage is mounted for movement along a generally horizontal path and said means yieldably urging said carriage toward said retracted position comprises weight means mounted for vertical movement and means operatively connecting said weight means to said carriage to yieldably urge the same horizontally along said path.

10. A flexible stock pay-off apparatus for maintaining a generally uniform tension on continuous flexible stock as it is withdrawn from a coil, the pay-off apparatus including a frame, a carriage mounted on the frame for movement relative thereto along a path between a retracted position and an extended position, a coil support mounted on the carriage for rotation about an axis transverse to said path in response to withdrawal of stock from a coil on the support, means biasing said carriage in one direction along said path with a preselected generally uniform force, variable brake means for controlling rotation of said coil support, and means operative for response to movement of the carriage along the path for variably operating the brake means to increase and decrease the braking action on the coil support as the carriage moves respectively toward and away from said retracted position until the exiting tension on the stock substantially equals said preselected force on the carriage.

11. A flexible stock pay-off apparatus according to claim 10 wherein said path extends generally horizontally.

12. A flexible stock pay-off apparatus according to claim 10 wherein said path extends generally horizontally and said carriage biasing means includes a weight and cable means connecting the weight to the carriage.

13. A method of controlling tension on continuous flexible stock as it is withdrawn in one direction from a coil of flexible stock comprising, supporting the coil of flexible stock for axial rotation about an axis extending transverse to the direction of stock withdrawal and for (limited) shifting movement lengthwise of said direction of stock withdrawal, yieldably opposing shifting movement of the coil in said direction of stock withdrawal with a biasing force, annd variably braking rotation of said coil about its axis to decrease the braking action on the coil as it shifts in said one direction to maintain the exiting tension on the stock substantially equal to said biasing force.

14. A method of controlling tension on continuous flexible stock as it is withdrawn from a coil of flexible stock according to claim 13 wherein said biasing force is maintained substantially constant at a preselected value whereby the tension on the exiting stock is maintained substantially constant.

15. A method of controlling tension on continuous flexible stock as it is withdrawn from a coil of stock according to claim 13 in which variable braking of rotation of the coil is in response to shifting movement of the coil lengthwise of the direction of stock withdrawal.

16. A method of controlling tension on continuous flexible stock as it is withdrawn from a coil of stock according to claim 13 in which variable braking of rotation of the coil is in response to shifting movement of the coil lengthwise of the direction of stock withdrawal, and said biasing force is maintained substantially constant at a preselected value as the stock coil shifts lengthwise of the direction of stock withdrawal.

* * * * *

UNITED STATES PATENT AND TRADEMARK OFFICE

CERTIFICATE OF CORRECTION

PATENT NO. : 4,004,750

DATED : January 25, 1977

INVENTOR(S) : Earl M. Seagrave, Jr.

It is certified that error appears in the above-identified patent and that said Letters Patent are hereby corrected as shown below:

Column 6, line 25, add -- means-- after "brake";

Column 8, line 7, correct the spelling of "and" to show -- and --.

Signed and Sealed this

Third Day of May 1977

[SEAL]

*Attest:*

RUTH C. MASON
*Attesting Officer*

C. MARSHALL DANN
*Commissioner of Patents and Trademarks*